US009981159B2

(12) United States Patent
Seven

(10) Patent No.: US 9,981,159 B2
(45) Date of Patent: May 29, 2018

(54) TKS HYDRAKICK SYSTEM

(71) Applicant: Anthony Dominic Seven, Salt Lake City, UT (US)

(72) Inventor: Anthony Dominic Seven, Salt Lake City, UT (US)

( * ) Notice: Subject to any disclaimer, the term of this patent is extended or adjusted under 35 U.S.C. 154(b) by 147 days.

(21) Appl. No.: 15/200,736

(22) Filed: Jul. 1, 2016

(65) Prior Publication Data

US 2018/0001146 A1 Jan. 4, 2018

(51) Int. Cl.

| | |
|---|---|
| ***A63B 31/10*** | (2006.01) |
| ***A63B 35/06*** | (2006.01) |
| ***A63B 31/00*** | (2006.01) |
| ***A63B 69/10*** | (2006.01) |

(52) U.S. Cl.

CPC ..... *A63B 31/10* (2013.01); *A63B 31/00* (2013.01); *A63B 35/06* (2013.01); *A63B 69/10* (2013.01)

(58) Field of Classification Search

CPC ..... A63B 69/12; A63B 31/10
USPC ..... 441/56
See application file for complete search history.

(56) References Cited

U.S. PATENT DOCUMENTS 4,519,783 A * 5/1985 Burke, Jr. ..... A63B 69/12 114/296
4,768,774 A * 9/1988 Beasley ..... A63B 21/0084 441/129
D323,371 S * 1/1992 Ohtaka ..... D21/803
D350,380 S * 9/1994 Rothhammer ..... D21/803
5,460,113 A * 10/1995 Gunter ..... B63B 21/00 114/230.2
5,601,514 A * 2/1997 Horn ..... A63B 69/12 434/254
6,176,815 B1 * 1/2001 Riera ..... A63B 69/12 441/117
6,475,048 B2 * 11/2002 Gredy ..... B63B 21/00 114/230.1
6,966,870 B2 * 11/2005 Lan ..... A63B 69/12 434/254
D667,910 S * 9/2012 Behr ..... D21/803
8,795,014 B2 * 8/2014 McCarthy ..... A63B 23/03541 441/129
2016/0375294 A1 * 12/2016 Grimaud ..... A63B 21/072 482/93

* cited by examiner

*Primary Examiner* — Joshua T Kennedy

(57) ABSTRACT

A stationary aquatic kickboard for leg kicking exercises in water. Aging and quadriceps decline are the origin of this products creation. TKS is anchored to the swimming pool wall or deck by two separate lines having equal tension when in use. The buoyancy of the kickboard is adjustable to accommodate persons of different body weight and for the preferred level of floatation. The handle grips positions will permit user to exercise in the prone or supine positions. Board and handle grips will provide high stability to do high intensity leg kicking action. This equipment is able to detach for removal from pool. TKS Hydrakick system will be used for exercise, physical therapy, relaxation or recreation. TKS hydrakicking is optimal lower extremity exercise and does not cause trauma to the legs.

1 Claim, 4 Drawing Sheets

TKS HYDRAKICK SYSTEM

Exercise device for aquatic leg kicking action in a stationary position.

BACKGROUND OF INVENTION

Field of invention is exercise science. This is the introduction of stabilized stationary kickboard training to the fitness industry. Aging and quadriceps decline are the origin of this products creation. Existing comparable equipment for leg swim kick exercise to consider are the ocean wave riding boogie board and standard swimming pool kickboard. A simple waist line is also mentioned below.

Standard kickboards found at public swim pools are very low buoyancy and are not anchored in position. Insufficient buoyancy will impair activity in mention and requires excessive energy. That is energy not used toward intended conditioning goal. That will be unnecessary fatigue.

A more supportive boogie board does not anchor in position and needs significant structural modification to do exercise that can be done with the TKS stationary kickboard.

With existing kickboards a user has to stop and turn around to continue exercise. That is a stop turn every 40 seconds during 20 minutes of continuous exercise.

For equipment that uses a line to attach to the waist of body holding exerciser in a stationary position. There is no buoyancy support for the body with that equipment. That would be an entirely different exercise.

TKS hydrakick system is a stationary kickboard with adjustable buoyancy. It allows for uninterrupted leg kicking exercise. No stop turns has many benefits, especially enjoyment of activity.

TKS stationary kickboard will allow for higher intensity leg kick training because it is anchored in position and will have durable structure. The greater range of intensity possible for users will increases scope of applications.

TKS will have adjustable buoyancy. Proper bodyweight support improves stability at all intensities and is energy conserving. The greatest benefit from the least effort in training. Energy conservation is of the highest importance in exercise science.

Stationary kickboard exercise is a warm up for leg muscles and increases circulation without trauma to the legs. Especially the exercisers joints and tendons. Aging and quadriceps decline are the origin of this products creation. It may be used for exercise, physical therapy, relaxation or recreation.

Special populations that will benefit from this product are very big people, like NBA and NFL athletes or those who are growing fast. Those who have anorexia or age related sarcopenia. Exercisers from beginning to elite will benefit from this equipment. Also, enjoyment from TKS will increase adherence to activity.

SUMMARY OF THE INVENTION

TKS Hydrakick system is a stationary aquatic kickboard. The use of this product is for leg kicking exercises in water. It will be anchored to the swimming pool wall or deck by two separate lines. Those lines distribute even tension and are flexible. The buoyancy of the kickboard is adjustable to accommodate persons of different body weight and for the preferred level of floatation. The handle grips position permit user to exercise in prone or supine position. Board and handle grips will provide stability to do high intensity leg kicking. This equipment will be able to detach for removal from pool.

Aging and quadriceps decline are the origin of this products creation. Stationary kickboards will be used for exercise, physical therapy, relaxation or recreation. TKS hydrakicking will make it easier to keep active without trauma to the legs.

DETAILED DESCRIPTION OF INVENTION

The following description represents the best current mode for making and using this invention. Purpose of invention is illustrated by mode described but should not be limited to designs listed.

Figure 1:
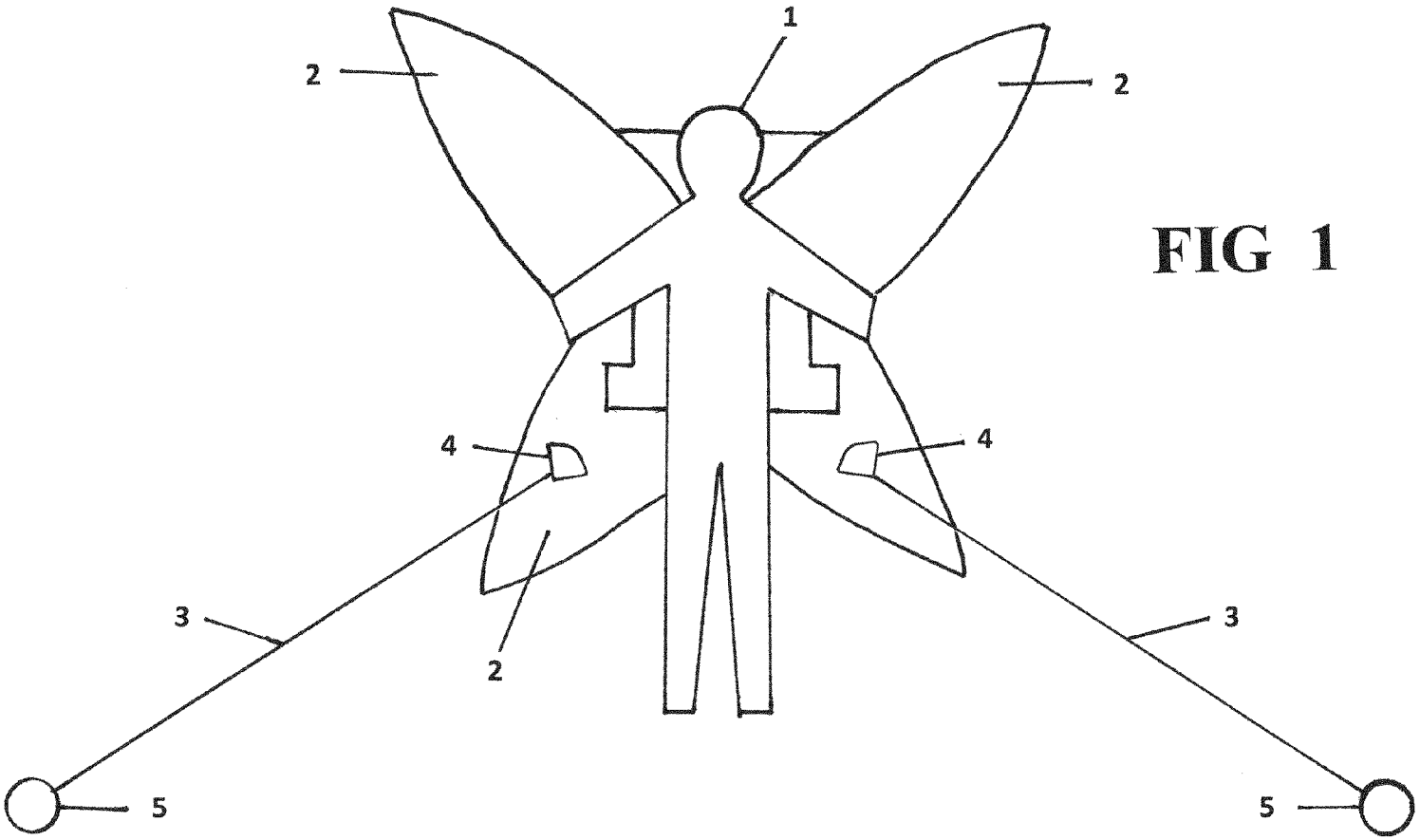
FIG. 1 illustrates an elevation view looking down on exerciser using butterfly design stationary kickboard, anchored by flexible line to swimming pool wall.

Referring to FIG. 1, butterfly design stationary kickboard 2 is to be used for swimming pool leg kicking exercise. Stationary kickboard may have different shapes and will typically be made of buoyant material such as polypropylene but may also be inflatable. Enclosed PVC pipe where contained air provides sufficient buoyancy could be a kickboard construct. Buoyancy of kickboard may be adjustable to stay on water surface or for partial submersion during exercise.

The equipment will have an exerciser 1. Exerciser 1 may use the equipment in a prone position FIG. 2 or supine position FIG. 3 while holding onto handle grips 7 and 6 respectively.

FIG. 1 The kickboard 2 will have an anchor 5 which is a fixed stainless steel eye bolt that is drilled into pool wall. Anchor 5 site may also use existing swim lane line attachment sites if they are already mounted in pool.

Also FIG. 1 are right and left attachment lines 3, one on each side of the kickboard, are made of flexible nylon or dense elastic material with some stretching ability. Lines 3 attach at opposing anchors 5 and extend to a right and left kickboard attachment 4 site. Lines 3 tension should distribute evenly. All line attachments use any clipping mechanism or tying a knot with rope or webbing. Both right side and left side attachment lines 3 will be 10 feet in length. Both lines 3 may have adjustable length. However, length of lines must give user sufficient leg clearance away from the pool wall to allow for unobstructed swim kicking exercise in a stationary position.

Figure 2:
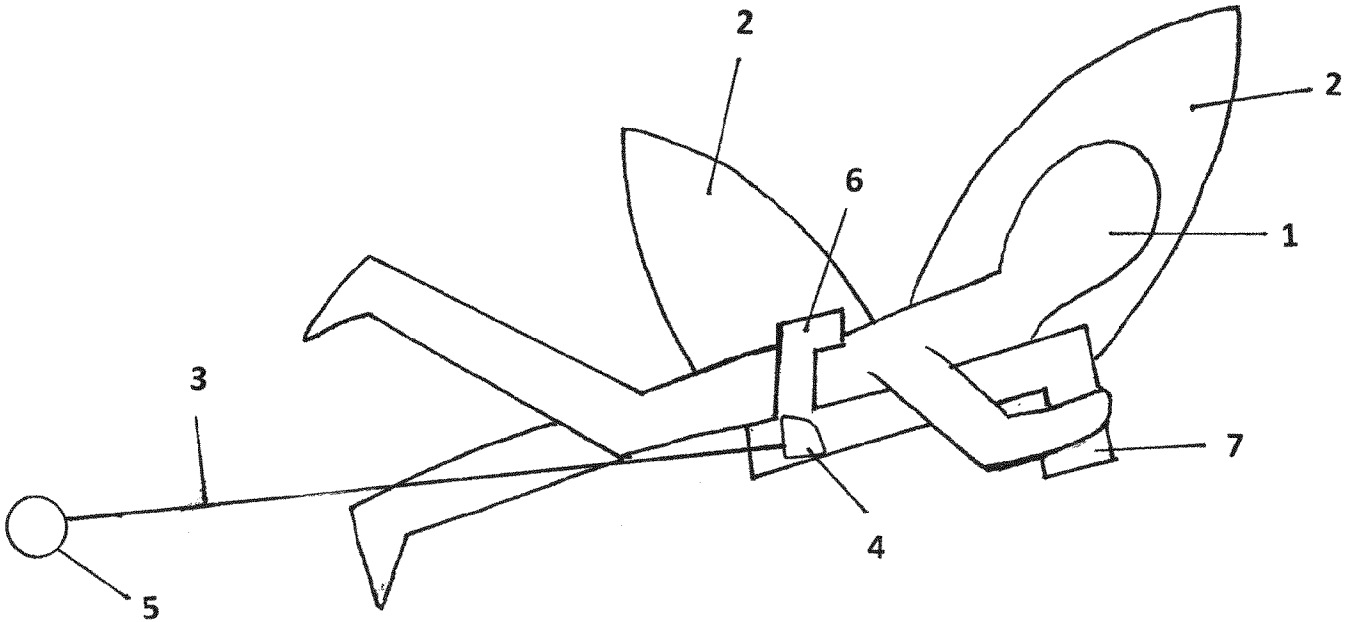
FIG. 2 illustrates a cross sectional side view of one half stationary kickboard with exerciser using apparatus in prone position holding onto handle grips fixed to underside near head.
Figure 3:
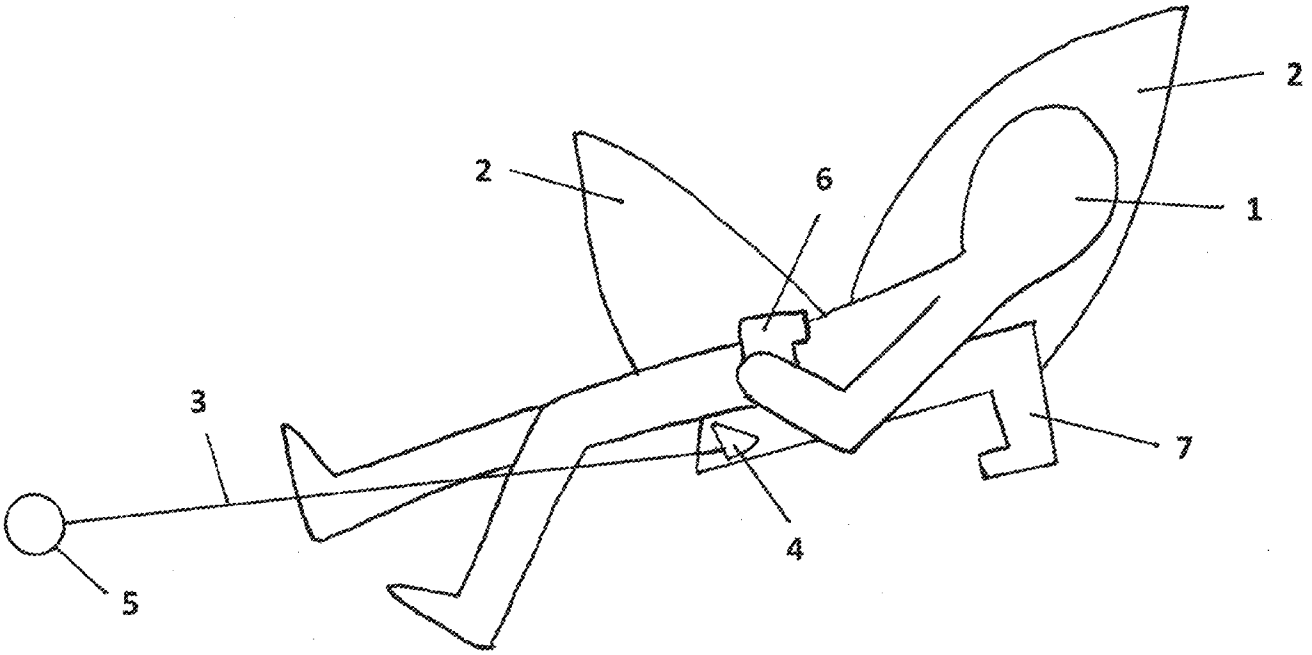
FIG. 3 illustrates a cross sectional side view of one half stationary kickboard with exerciser using apparatus in supine position holding onto handle grips fixed on topside near hips.

FIG. 2 and FIG. 3 show handle grips 6 and 7. Both 6 and 7 have a right and left handle grip. Handle grips will be firmly attached to kickboard giving exerciser proper stability and leverage during high intensity leg kicking action. Handle grips will be made of high strength plastic, wood, metals or comparable material or may use flexible nylon rope. Two handle grips 7, right and left will be mounted on underside of kickboard near head of exerciser. Grips 7 are positioned to allow for use of equipment in a prone position FIG. 2. Two handle grips 6, right and left will be mounted to topside of kickboard near hip area of user. Grips 6 are positioned to allow use of equipment in supine position FIG. 3.

Figure 4:
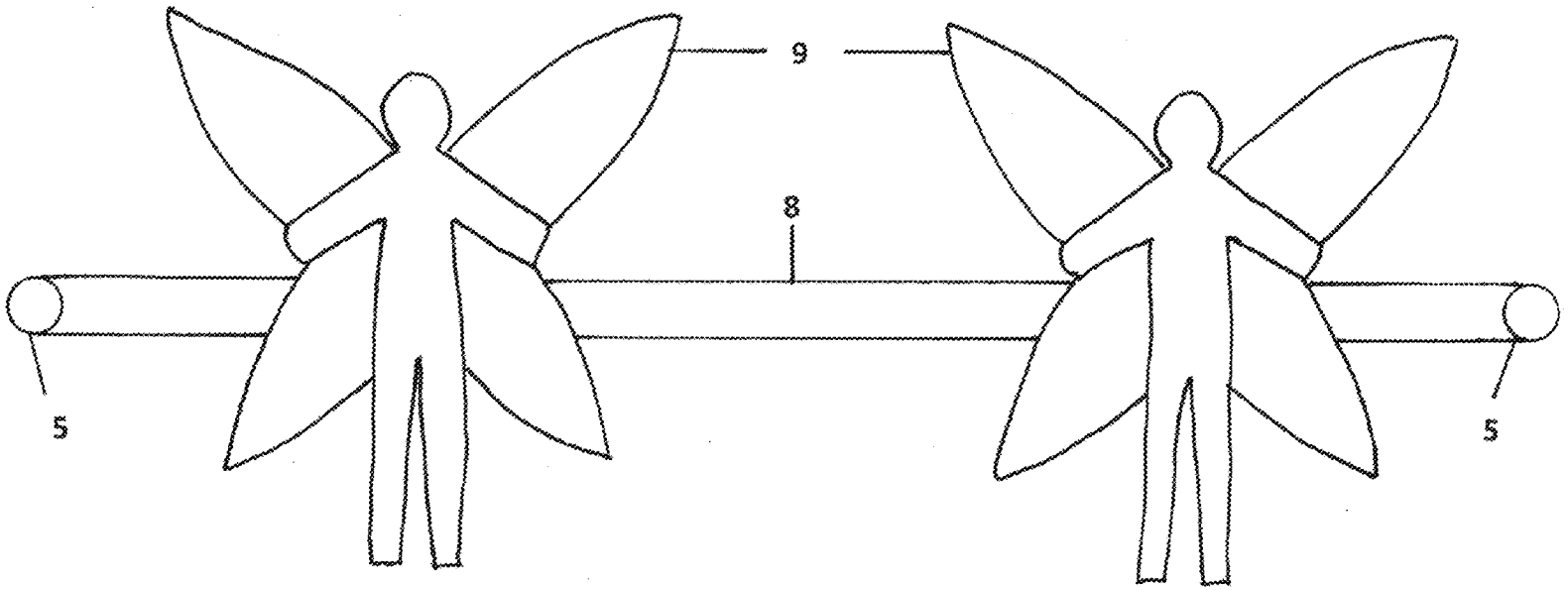
FIG. 4 illustrates an elevation view looking down on multiple fixed stationary kickboard exercise machines anchored to pool wall using a rigid bar.

Referring to FIG. 4 a design with multiple stationary kickboards 9 attached and anchored by line 8. Attachment line 8 is a rigid non-flexible straight bar. It could be made of material such as wood, metals, high strength plastic. It is an alternative method for anchoring stationary kickboard in pool. This construction will allow more than one exerciser with multiple anchored kickboards to do stationary kicking at the same time.

All stationary kickboard systems may be permanently fixed or may detach for removal from pool. Stationary kickboard could be made from non-buoyant material if built and anchored so kickboard remains on surface of water or is partially submerged allowing for said aquatic exercise in a stationary position.

Stationary kickboard exercise is a warm up for leg muscles and increases circulation without trauma to the legs. Especially the exercisers joints and tendons. Aging and quadriceps decline are the origin of this products creation. It may be used for exercise, physical therapy, relaxation or recreation.

The invention has been described with respect to the illustrations and embodiments. It should be understood by those skilled in the science that changes in form and details may be made without departing from the spirit and scope of the invention.

I claim:

1. A stationary kickboard configured to be anchored in place for aquatic leg kicking exercise, the kickboard comprising:

a buoyant body having forward and rear ends and upper and lower surfaces extending there between, the buoyancy of the body being adjustable;

a first set of right and left handle grips extending outwardly from the upper surface at middle portion of the body to facilitate use of the kickboard in a supine position;

a second set of right and left handle grips extending outwardly from the lower surface at the forward end of the body to facilitate use of the kickboard in a prone position;

an anchor system comprising attachment lines on both sides of the body being configured to be removably or permanently fixed in pool such that a user may use the kickboard to kick their legs in aquatic exercise while being properly supported in a stationary position.

* * * * *